US011499367B2

(12) United States Patent
Vasylyev

(10) Patent No.: US 11,499,367 B2
(45) **Date of Patent: *Nov. 15, 2022**

(54) LIGHT-REDIRECTING WINDOW COVERING

(71) Applicant: Sergiy Vasylyev, Elk Grove, CA (US)

(72) Inventor: Sergiy Vasylyev, Elk Grove, CA (US)

(73) Assignee: S.V.V. TECHNOLOGY INNOVATIONS, INC., Sacramento, CA (US)

( * ) Notice: Subject to any disclaimer, the term of this patent is extended or adjusted under 35 U.S.C. 154(b) by 152 days.

This patent is subject to a terminal disclaimer.

(21) Appl. No.: 16/801,097

(22) Filed: Feb. 25, 2020

(65) Prior Publication Data

US 2020/0190901 A1 Jun. 18, 2020

Related U.S. Application Data

(63) Continuation of application No. 15/458,006, filed on Mar. 13, 2017, now Pat. No. 10,577,859, which is a continuation of application No. 14/732,685, filed on Jun. 6, 2015, now abandoned.

(60) Provisional application No. 62/010,432, filed on Jun. 10, 2014.

(51) Int. Cl.

| | |
|---|---|
| ***E06B 9/42*** | (2006.01) |
| ***F21S 11/00*** | (2006.01) |
| ***F21V 14/00*** | (2018.01) |
| ***E06B 9/66*** | (2006.01) |
| *E06B 9/24* | (2006.01) |

(52) U.S. Cl.

CPC ..... *E06B 9/42* (2013.01); *E06B 9/66* (2013.01); *F21S 11/007* (2013.01); *F21V 14/006* (2013.01); *E06B 2009/2405* (2013.01); *E06B 2009/2411* (2013.01); *E06B 2009/2417* (2013.01)

(58) Field of Classification Search

CPC ..... E06B 2009/2405; E06B 2009/2411; E06B 2009/2417; E06B 9/42; E06B 9/66; F21S 11/007

See application file for complete search history.

(56) References Cited

U.S. PATENT DOCUMENTS

| | | | | |
|---|---|---|---|---|
| 693,088 | A * | 2/1902 | Wadsworth | E06B 9/24 362/342 |
| 737,979 | A | 9/1903 | Wadsworth | |
| 2,689,387 | A | 9/1954 | Carr | |
| 3,975,083 | A | 8/1976 | Rowland | |
| 4,025,159 | A | 5/1977 | McGrath | |
| 4,773,733 | A | 9/1988 | Murphy, Jr. et al. | |
| 4,906,070 | A * | 3/1990 | Cobb, Jr. | F21V 5/002 359/834 |
| 5,295,051 | A | 3/1994 | Cowling | |

(Continued)

*Primary Examiner* — Johnnie A. Shablack

(57) ABSTRACT

A window covering for natural illumination of building interiors by redirecting the incident daylight at angles that promote its deeper penetration into the interior space. The window covering comprises an optically transmissive, flexible polymeric sheet having a layered structure with a light diffusing output surface and a number of total internal reflection surfaces incorporated into its material. The total internal reflection surfaces are dimensioned such that the multi-layer sheet diffusely redirect at least a portion of light towards a direction which is generally not coincident with the incidence direction.

22 Claims, 10 Drawing Sheets

(56) References Cited

U.S. PATENT DOCUMENTS 5,461,496 A 10/1995 Kanada et al.
5,650,875 A 7/1997 Kanada et al.
5,671,387 A 9/1997 Jacobs et al.
5,880,886 A 3/1999 Milner
6,239,910 B1 5/2001 Digert
6,311,437 B1 11/2001 Lorenz
6,367,937 B2 4/2002 Koster
6,435,683 B1 * 8/2002 Milner ..... F21S 11/00 359/613
6,437,921 B1 8/2002 Whitehead
6,700,716 B2 3/2004 Sejkora
6,714,352 B2 * 3/2004 Rogers ..... F21V 11/02 359/597
6,980,728 B2 12/2005 Ladstatter et al.
6,997,595 B2 2/2006 Mi et al.
7,070,314 B2 7/2006 Edmonds
7,703,969 B2 4/2010 Miyashita
8,107,164 B2 1/2012 Tsai
8,213,082 B2 7/2012 Gaides et al.
8,824,050 B2 9/2014 Vasylyev
8,934,173 B2 * 1/2015 Vasylyev ..... B29D 11/00663 359/597
9,004,726 B2 * 4/2015 Vasylyev ..... G02B 6/0053 362/330
9,007,688 B2 * 4/2015 Vasylyev ..... F21S 11/00 359/595
9,366,403 B2 * 6/2016 Kashiwagi ..... G02B 5/0231
9,429,288 B2 * 8/2016 Ueki ..... G02B 5/0242
9,719,644 B2 * 8/2017 Sekido ..... F21S 11/007
9,885,453 B2 * 2/2018 Tsujimoto ..... E06B 9/264
10,012,356 B1 * 7/2018 Rogers ..... F21S 11/007
10,184,623 B2 1/2019 Vasylyev
10,577,859 B2 * 3/2020 Vasylyev ..... E06B 9/66
10,882,223 B2 * 1/2021 Ueki ..... E04D 13/033
2003/0234087 A1 12/2003 Jones
2008/0030859 A1 2/2008 Usami
2008/0273143 A1 11/2008 Yao et al.
2012/0033302 A1 2/2012 Suzuki et al.
2012/0092756 A1 4/2012 Yoshida et al.
2012/0118514 A1 5/2012 Hughes
2012/0327507 A1 12/2012 Padiyath et al.
2013/0038928 A1 2/2013 Padiyath et al.
2013/0265642 A1 10/2013 Vasylyev
2015/0049387 A1 2/2015 Kashiwagi et al.
2015/0153013 A1 * 6/2015 Wu ..... G02B 3/0068 359/593
2015/0285454 A1 10/2015 Aizenberg et al.
2015/0337593 A1 11/2015 Pricone
2015/0354272 A1 * 12/2015 Vasylyev ..... F21S 11/007 160/133
2016/0011346 A1 1/2016 Vasylyev
2016/0025288 A1 1/2016 Vasylyev
2017/0023197 A1 * 1/2017 Ueki ..... F21V 3/049
2017/0114590 A1 * 4/2017 Shinozaki ..... G02B 5/00
2017/0165947 A1 * 6/2017 Murakami ..... G02B 5/02

* cited by examiner

LIGHT-REDIRECTING WINDOW COVERING

CROSS-REFERENCE TO RELATED APPLICATIONS

This application is a continuation of U.S. patent application Ser. No. 15/458,006, filed Mar. 13, 2017, which is a continuation of U.S. patent application Ser. No. 14/732,685, filed Jun. 6, 2015, incorporated herein by reference in its entirety, and claims priority from U.S. provisional application Ser. No. 62/010,432 filed on Jun. 10, 2014, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

The present invention relates to a window covering, and more particularly, to a manually-controlled or motorized roller shade system having light-redirecting features. More particularly, this invention relates to roller window shade systems employing light directing sheets with embedded reflective surfaces.

2. Description of Background Art

Roller shades used to control the amount of sunlight entering a space and to provide privacy are usually mounted in front of windows or openings in building facades and employ flexible shade fabric wound onto an elongated roller tube for raising and lowering the shade fabric by rotating the roller tube. In a typical roller shade, the fabric is either opaque or translucent which limits light control to blocking or admitting light by lowering and raising the shade. However, many applications exist where it is desired that the roller coverings could redirect light instead of blocking. For example, daylight intercepted by a roller shade can be harvested and used for illumination by redirecting it to the ceiling of a building interior, thus saving electric energy. Redirecting excess light to the ceiling can also reduce the intensity of the direct beam propagating in the downward direction thus reducing glare and improving comfort for building occupants.

BRIEF SUMMARY OF THE INVENTION

The present invention solves a number of daylight harvesting and distribution problems within a window covering including a thin and flexible light redirecting sheet which is windingly received around at least one roller. Apparatus and method are described for controlled directing and distributing daylight within building interior using such covering in which the light redirecting functionality of the flexible sheet is provided by an array of reflective surfaces included into the sheet material.

According to one embodiment of the invention, the reflective surfaces are formed by deep and narrow channels or slits formed in a surface or within a bulk of the material. According to one aspect of the invention, such slits or channels may form optical surfaces redirecting light by a total internal reflection (TIR). Daylight passes through the sheet-form material configured with the embedded reflective surfaces and is redirected into building interior at high deflection angles with respect to the incident direction. According to one embodiment, According to one embodiment of the invention, the flexible light redirecting sheet is formed from an optically clear or translucent polymeric material. In different implementations, the material may comprise plasticized polyvinyl chloride, thermoplastic polyurethane, polycarbonate, poly(methyl methacrylate) (also commonly referenced to as PMMA or acrylic), polyester, polyethylene, or cyclic olefin copolymer.

According to one embodiment of the invention, the flexible light redirecting sheet is configured for a generally unimpeded transversal light passage and/or providing a generally undistorted view of objects behind the sheet at least along a normal viewing direction.

Further elements of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus and method generally shown in the preceding figures. It will be appreciated that the apparatus and method may vary as to configuration and as to details of the parts without departing from the basic concepts as disclosed herein. Furthermore, elements represented in one embodiment as taught herein are applicable without limitation to other embodiments taught herein, and in combination with those embodiments and what is known in the art.

Figure 1:
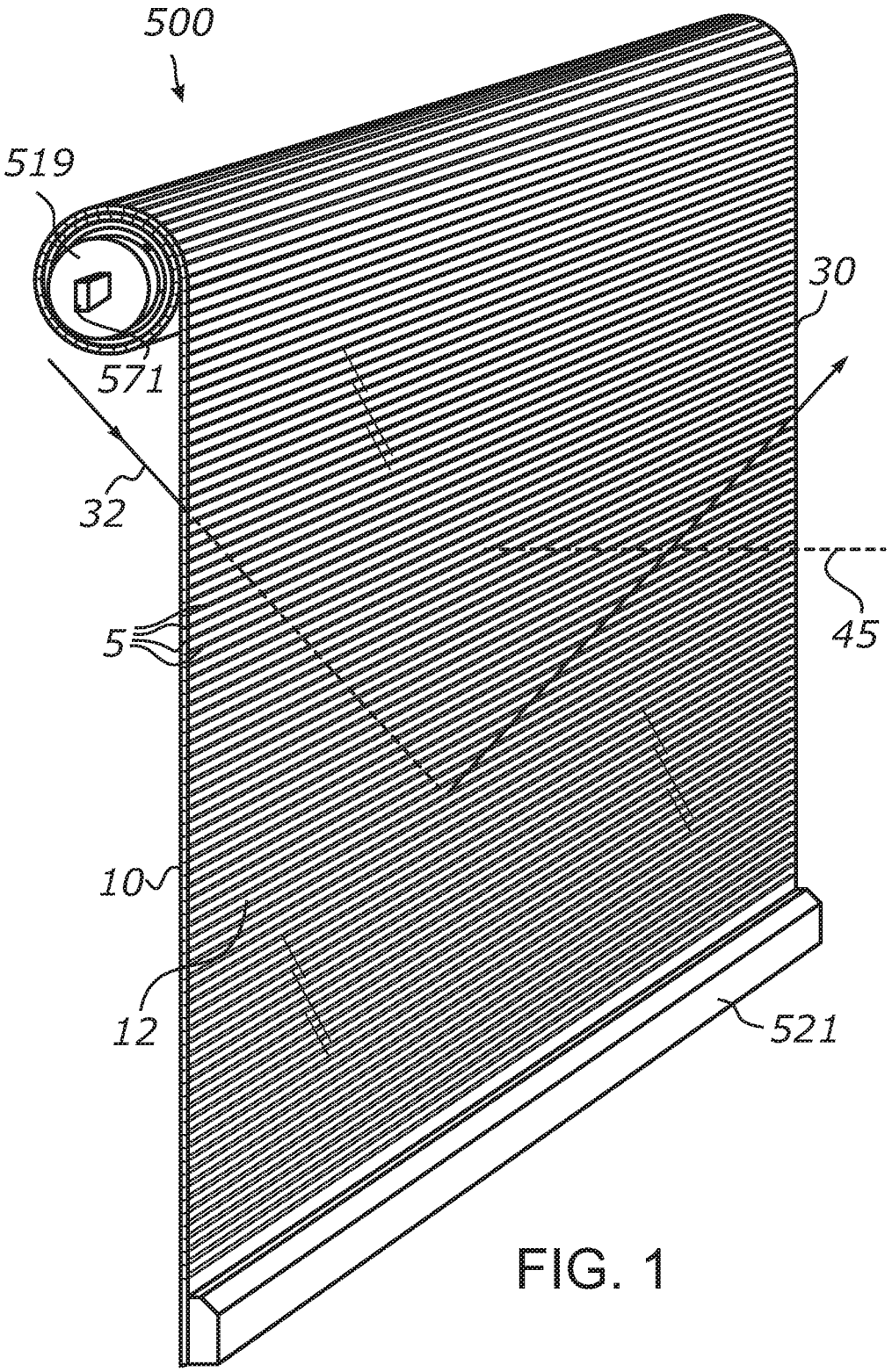
FIG. 1 is a schematic perspective view of a light-redirecting retractable roller window covering, according to at least one embodiment of the present invention.

FIG. 1 is a perspective view of a light-redirecting roller window covering 500 according to an embodiment of the present invention. The roller window covering 500 comprises a highly flexible light redirecting sheet 30 that is windingly received around a roller 519. Sheet 30 has a rectangular shape, a first terminal end connected to roller 519 and a second terminal end opposite the first terminal end. Sheet 30 should preferably be soft and flexible with fabric-like behavior so that it could be freely wound and unwound to and from roller 519.

Roller 519 includes a tubular member for winding sheet 30 around it and is further provided with a spring-assisted rewind mechanism such as those that may commonly be found in roller blinds and/or shades. A bar 521 is provided on the second terminal end of sheet 30. Such bar 521 may be conventionally made from wood, metal or plastics. Its weight may be selected to be appropriate for slight tensioning of sheet 30 and preventing or reducing the material wrinkling. Bar 521 may also be conventionally used for manual lowering and raising the fabric of sheet 30.

Suitable mounting hardware, such as brackets and clips (not shown) may be provided for mounting roller 519 to the inside of the window frame or to other structural elements surrounding the window. The two opposite ends of roller 519 may be rotatably coupled at the roller ends to such mounting brackets or clips, which in turn can be connected to a vertical surface, e.g., a wall. A rectangular protrusion 571 may be provided on one side of roller 519 to facilitate mounting the axis of the spring-loaded roller to an external bracket in a fixed position. Roller 519 may further comprise a manual clutch mechanism to provide for manual or motorized rotation of the roller so as to raise and lower sheet 30 between a fully-closed position and a fully-open position, thus making window covering 500 retractable. Similarly to conventional retractable roller-based window coverings, roller 519 may be configured to be operable manually in response to a pull down force applied by an operator to sheet 30 or by electrical motor directly driving the roller itself. Roller 519 may be further provided with an optional cover and/or integrated into a headrail system.

According to one aspect of the present invention, sheet 30 windingly receivable around roller 519 may simply replace the cloth of fabric of a conventional roller blind or shade. However, unlike such conventional window coverings, covering 500 performs at least a light redirecting function so that at least a portion of the daylight received on a surface of covering 500 can be redirected by a relatively large bend angle. In addition, covering 500 may perform common functions of window coverings or shades such as, for example, light filtering, decorative functions and/or privacy functions.

Sheet 30 is defined by a first major surface 10 and an opposing parallel major surface 12 and is made of a solid, non-woven, optically transmissive material which may have one or more layers. The material should preferably have a solid, homogenous structure such as that commonly found in polymeric films and sheets. Suitable materials for such layers may include various clear or translucent polymers such as polyvinyl chloride, polycarbonate, poly(methyl methacrylate) (also commonly referenced to as PMMA or acrylic), polyester, polyethylene, polyurethane, and the like. Sheet 30 should have sufficient flexibility to be woundable onto roller 519 without using excessive tension. Accordingly, when sheet 30 is formed by two or more layers, the materials of each layer should be sufficiently thing and flexible so that the resulting multilayered structure also has sufficient flexibility for winding and unwinding to and from roller 619.

According to one embodiment, at least one layer of sheet 30 can be made from a soft and flexible material such as plasticized polyvinyl chloride (also frequently referred to as PVC-P, plasticized PVC, flexible PVC or simply vinyl) or thermoplastic polyurethane (TPU). The material should preferably be optically clear but may also have some tint or haze that do not substantially impair its light transmissive properties. Other suitable materials that may potentially be used in place of plasticized PVC or TPU include but are not limited to optically clear or translucent thermoplastic elastomers and silicones. The outer layer(s) may be made from the same or different soft and optically transmissive material or from rigid materials such as, for example, polycarbonate, polystyrene, rigid polyvinyl chloride, polyester, fluoropolymers or cyclic olefin copolymer.

Sheet 30 has a plurality of linear internal reflectors 5 formed between surfaces 10 and 12. Reflectors 5 are also arranged so that they extend generally parallel to each other and parallel to the rotation axis of roller 519. Accordingly, it will be appreciated that, when window covering 500 is used to cover a vertical wall window with a horizontal disposition of roller 519, parallel reflectors 5 will also extend horizontally.

In one embodiment, sheet 30 is configured to provide a relatively high optical clarity so that window covering 500 can have a see-through appearance at least along a direction perpendicular to the sheet. In an alternative embodiment, sheet 30 may also be configured to appreciably distort or blur the images behind it and thus provide some privacy.

Internal reflectors 5 are so configured as to redirect at least a portion of light incident onto a major surface of sheet 30 from an off-normal direction. For instance, referring further to FIG. 1, a light ray 32 entering surface 10 from an off-normal direction is internally redirected by one of the reflectors 5 and exits from surface 12 towards a different direction. In one embodiment, reflectors 5 may be configured so that the bend angle in a plane perpendicular to reflectors 5 is approximately twice the angle of incidence of ray 32 onto the surface of sheet 30 in the same plane. The angle of incidence is measured between the incident ray and a line normal to the surface, such as a surface normal 45 shown in FIG. 1.

The window covering 500 of FIG. 1 may be used to improve the daylighting conditions of a building interior. In such daylighting operation, when sheet 30 is fully or partially unwound from roller 519, at least a portion of daylight entering covering 500 from high elevations can be redirected toward a ceiling and/or projected deep into the building interior. Accordingly, such redirected daylight may be distributed over the interior more efficiently and enhance natural illumination of the interior space. It will be appreciated that a light-colored or white-painted ceiling may scatter at least a portion of the redirected light and thus contribute to distributing the injected daylight more uniformly and extending the daylit area.

In one embodiment, roller 519 may be motorized. The motorized roller 519 may be controlled remotely using a stationary or handheld control unit. In one embodiment, window covering 500 may be provided with a continuous loop cord or beaded chain to lower and raise sheet 30.

Figure 2:
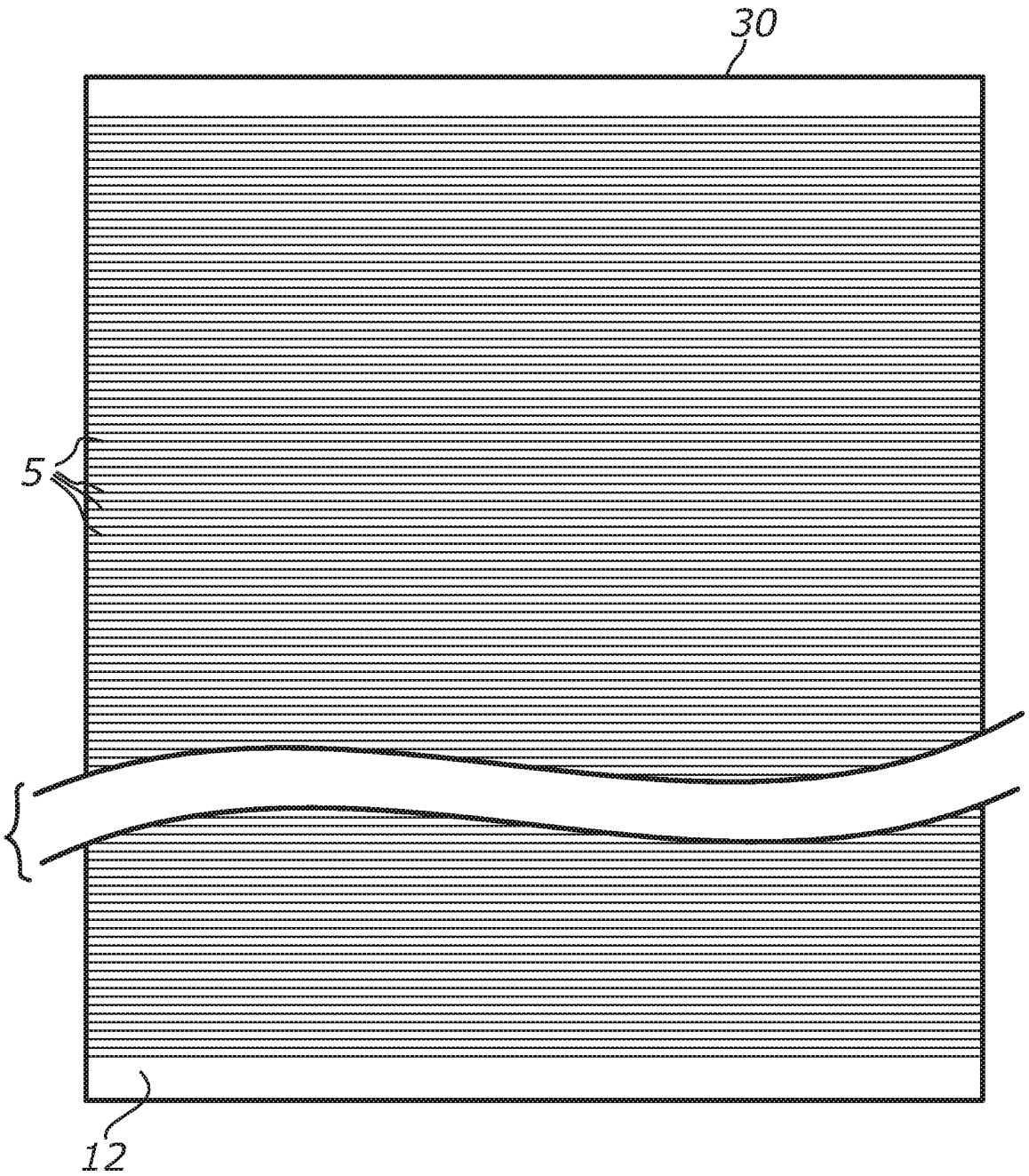
FIG. 2 is a schematic front view of a flexible and optically transmissive light directing sheet, according to at least one embodiment of the present invention.

FIG. 2 shows a schematic front view of sheet 30 in a rectangular configuration where linear reflectors 5 extend parallel to shorter sides of the rectangle. Such shorter sides of sheet 30 are also shown to have small bleed areas which are free from reflectors 5.

Figure 3:
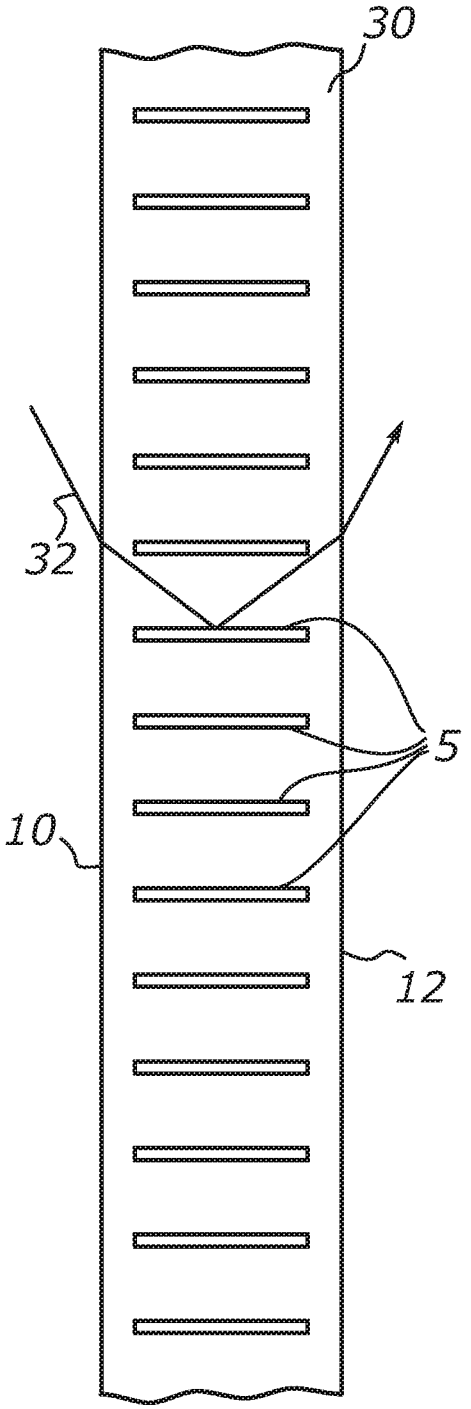
FIG. 3 is a schematic cross section view and raytracing of a light directing sheet portion, showing a plurality of internal reflectors, according to at least one embodiment of the present invention.

FIG. 3 shows a portion of sheet 30 in a cross-section perpendicular to the plane of the sheet. It further shows a plurality of planar channels formed in the material of the sheet 30 between surfaces 10 and 12. Each channel has a pair of opposing planar walls, each having a substantially smooth surface with a high-gloss appearance and forming an individual reflector 5. The opposing walls of each channel can be separated from each other by a relatively thin layer of air so that there is no physical contact with each other. The channels should preferably be embedded into the sheet material so that there is no contact of the channel interior with the environment and there are no interruptions of the major surfaces 10 and 12 of sheet 30. In addition, there should be sufficient thickness of the material between the channels ends and the closest major surface of sheet 30 in order to maintain the overall structural integrity of the sheet, particularly in response to bending, rolling and pull forces during normal use. The overall thickness of sheet 30 may be selected from the range of thicknesses that provides sufficient flexibility for the sheet to be woundable onto roller 519 and yet resistant to tearing or excessive stretching. In one embodiment, the thickness of sheet 30 is selected to correspond to the common thicknesses of film or thin sheet materials. More particularly, the thickness of sheet 30 can be selected from the range between 200 micrometers and 2 millimeters.

Reflectors 5 of FIG. 3 are configured for intercepting and reflecting at least a portion of light propagating through sheet 30 along an off-normal propagation direction. The preferred reflection mechanism is the total internal reflection (TIR) which occurs at the boundary between the material of sheet 30 and air between the respective pair of channel walls.

The light directing operation of sheet 30 is further illustrated by an example of ray 32 in FIG. 3. Ray 32 enters sheet 32 from an off-normal direction in the plane of the drawing and strikes one of the TIR reflectors 5. The angle of incidence of ray 32 onto the surface of the respective reflector 5 is greater than the critical angle of TIR which causes ray 32 to losslessly reflect from such surface. As a matter of optics, the angle of reflection of ray 32 is equal to its angle of incidence onto the surface of reflector 5. Accordingly, ray 32 is redirected from its original propagation path and exits from sheet 30 towards a direction which is different from its original propagation direction. It can be shown that, when reflector 5 is perpendicular to surfaces 10 and 12, the bend angle of ray 32 will be twice its angle of incidence onto surface 10 as a result of the ray passage through sheet 30. It will thus be appreciated that relatively high bend angles can be obtained, depending on the orientation of sheet 30 with respect to the incident light. For instance, at incidence angle exceeding 45°, the bend angle will generally be above 90°.

In order to operate properly, at least one of the opposing walls of the channels that form reflectors 5 should have a substantially smooth surface capable of reflecting light by means of a total internal reflection in a specular or near-specular regime while minimizing scattered light. It should be understood that the respective surfaces do not have to be absolutely smooth to provide such operation. It can be shown that a TIR surface may provide good reflectivity even with some non-negligible surface roughness as long as such roughness is significantly less than the wavelength. According to one embodiment, a root-mean-square (RMS) roughness parameter of the reflectors 5 may be within the range between 0.01 micrometers (10 nanometers) and 0.06 micrometers (60 nanometers), and more preferably between 0.01 micrometers (10 nanometers) and 0.03 micrometers (30 nanometers). The preferred sampling length for measuring such RMS roughness parameter should be between 20 and 100 micrometers and should not generally exceed the depth of the channels that form reflectors 5.

According to one embodiment, the width of the channels that form TIR reflectors 5 is made sufficiently low so as to provide for a generally unimpeded transversal light passage and minimize light interception by the channels' edges. Furthermore, surfaces 10 and 12 can be made sufficiently smooth so that sheet 30 can have a substantially transparent appearance when viewed at normal angles. The term "substantially transparent" is directed to mean an optical property of a clear sheet material at which objects behind the sheet can be seen clearly and generally free from major visual distortions. It is noted that sheet 30 does not have be highly transparent such as, for example, a clear sheet of glass in order to be considered substantially transparent. However, a heavily textured, e.g., prismatic, sheet is not considered substantially transparent since it can significantly distort the objects behind it or notably alter the apparent objects' position even when viewed along a normal direction.

Figure 4:
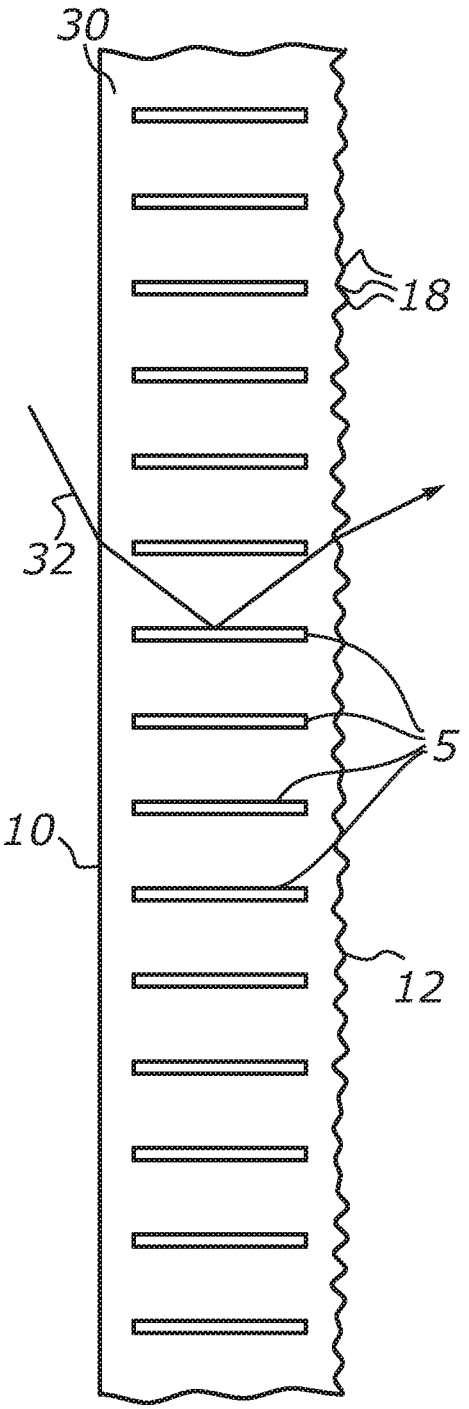
FIG. 4 is a schematic cross section view and raytracing of a light directing sheet portion, showing a plurality of internal reflectors and further showing surface microstructures in a major surface of the sheet, according to at least one embodiment of the present invention.

FIG. 4 shows a portion of sheet 30 which is similar to that of FIG. 3 except that surface 12 is textured and includes a plurality of microstructures 18 configured for diffusing light that emerges from sheet 30. In such a configuration of sheet 30, the emergence angle of ray 32 can be randomized, within a certain angle defined by the relief of surface 12, and will generally not be the same as in the case of the smooth surface 12 of FIG. 3. In a further contrast to the embodiment of FIG. 3, sheet 30 of FIG. 4 can have a reduced transparency and may also have a distinct matte finish. Accordingly, besides improved light diffusion, the microstructured version of sheet 30 may also enhance privacy.

Figure 5:
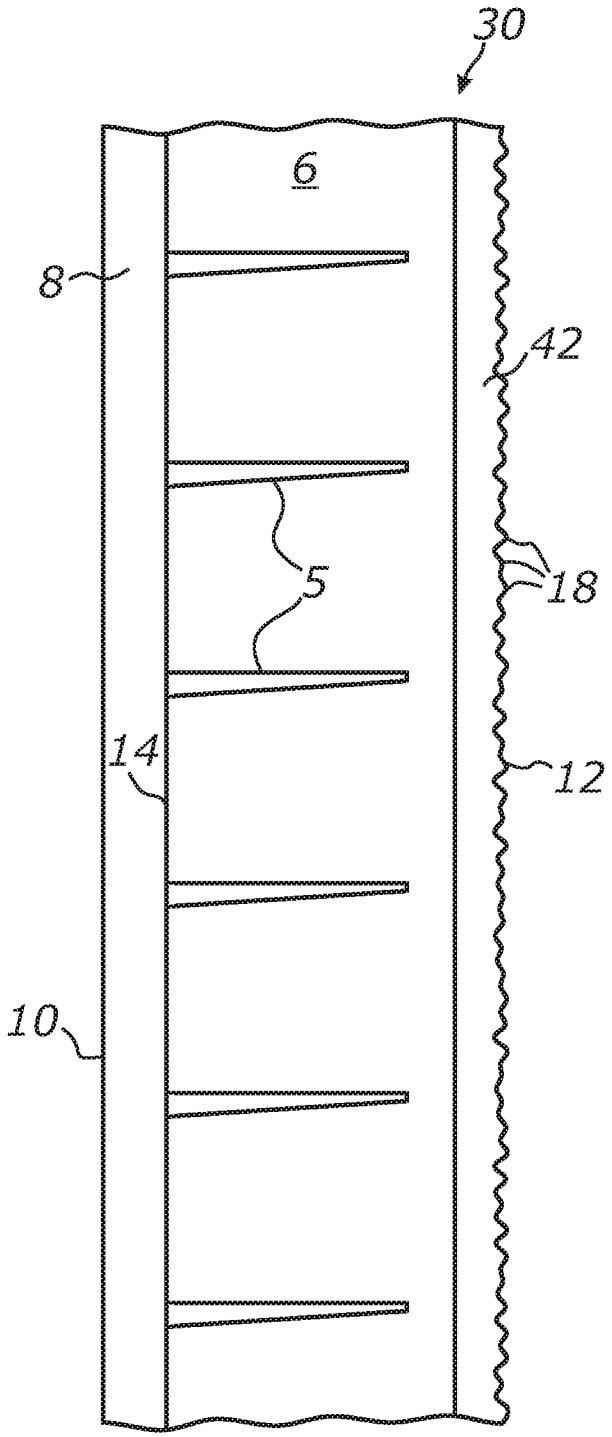
FIG. 5 is a schematic cross section view of a light directing sheet portion, showing a plurality of internal reflectors and further showing additional layers of optically transmissive materials, according to at least one embodiment of the present invention.

The channels that form TIR reflectors 5 may be embedded into sheet 30 using any suitable means. For instance, such channels may be formed in a surface of an optically transmissive film or sheet material and the respective surface may then be covered with another optically transmissive layer. This is illustrated in FIG. 5 in which a plurality of narrow channels is formed in a surface 14 of an inner sheet 6 sandwiched between protective outer sheets 8 and 42. Sheet 8 covers the opening of the channels and protects TIR reflectors 5 from the environment. Sheet 42 is shown with optional microstructures 18 formed in surface 12. Sheets 8 and 42 may be bonded to the respective surfaces of sheet 30 using optically transmissive adhesives, heat-induced bonding (for example, by using radio-frequency (RF) or ultrasound), or by any other suitable means or processes.

The parallel channels of FIG. 5 may be formed by any suitable technique including but not limited to molding, microreplication, embossing, mechanical cutting, laser cutting, etching, slitting, and the like. By way of example and not limitation, sheet 6 may be formed from an acrylic (PMMA) material and the channels may be formed by cutting surface 14 with a focused beam of a carbon dioxide laser ($CO_2$ laser) having the principal wavelength band centering around 10.6 micrometers. It will be appreciated by those skilled in the art that ablating acrylic material with a $CO_2$ laser may produce narrow channels with smooth, TIR-capable walls.

In another non-limiting example, inner sheet 6 may be formed from a relatively soft material, such as PVC-P or TPU, which can be slit using a sharp blade or razor. The TIR channels may be particularly produced by slitting surface 14 and slightly stretching the material along a direction perpendicular to the slitting direction to prevent the opposing walls of the resulting channels to close upon one another. Such method is described, for example, in U.S. Pat. No. 8,824,050 herein incorporated by reference in its entirety. Sheets 8 and 42 can be made scratch- and/or radiation-resistant and configured to protect the inner sheet 6 from the environment.

The voids formed by the TIR channels may be ordinarily allowed to be filled with air upon forming. Air has a low refractive index ($n \approx 1$) and can provide TIR operability of the channel walls in a broad range of incidence angles. The air may be demoisturized in order to prevent moisture condensation at the channel walls at high temperature variations. The channels may also be filled with a fibrous or porous filler material to prevent the channel walls from closing upon each other. In a further alternative, the channels may be filled with a dielectric material having a substantially lower refractive index than the bulk material of sheet 3 in which the channels are formed. While such material may have a greater refractive index than air thus reducing the range of angles at which the channel walls could reflect light by means of TIR, the resulting monolithic construction could have improved structural integrity and resistance to tearing. By way of example and not limitation, such low-n material may include certain types of silicones or fluoropolymers having the refractive index in 1.29-1.41 range.

Figure 6:
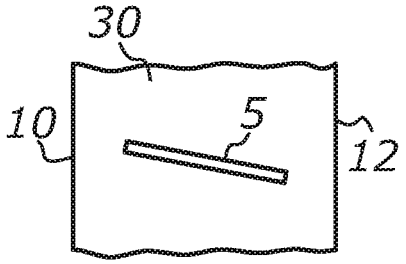
FIG. 6 is a schematic cross section view of a light directing sheet portion, showing an internal reflector sloped at an angle with respect to a surface of the sheet, according to at least one embodiment of the present invention.
Figure 7:
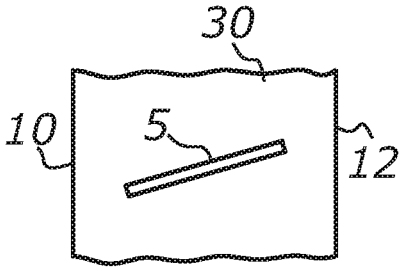
FIG. 7 is a schematic cross section view of a light directing sheet portion, showing an internal reflector sloped at another angle with respect to a surface of the sheet, according to at least one embodiment of the present invention.
Figure 8:
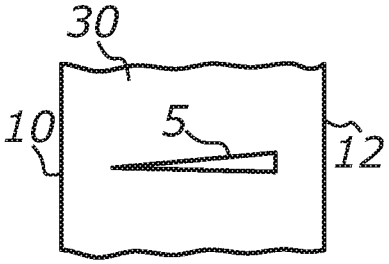
FIG. 8 is a schematic cross section view of a light directing sheet portion, showing an internal reflector formed by a wedge-shaped void in the material of the sheet, according to at least one embodiment of the present invention.
Figure 9:
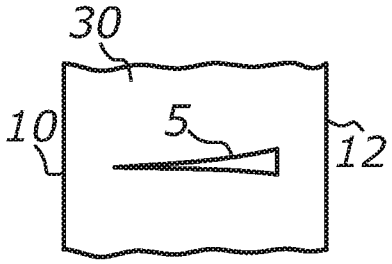
FIG. 9 is a schematic cross section view of a light directing sheet portion, showing an internal reflector having a concave shape, according to at least one embodiment of the present invention.
Figure 10:
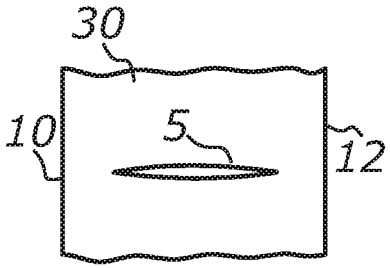
FIG. 10 is a schematic cross section view of a light directing sheet portion, showing an internal reflector having a convex shape, according to at least one embodiment of the present invention.
Figure 11:
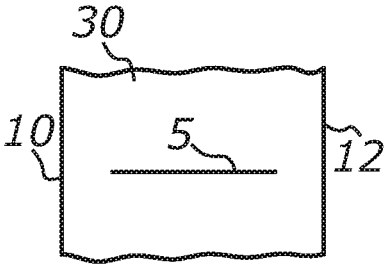
FIG. 11 is a schematic cross section view of a light directing sheet portion, showing an internal reflector having a mirrored surface, according to at least one embodiment of the present invention.

FIG. 6 through FIG. 11 show various exemplary configurations of reflectors 5 embedded into sheet 30. In FIG. 6, reflector 5 is formed by a planar channel sloped at an angle with respect to a normal to surfaces 10 and 12. In FIG. 7, reflector 5 is formed by a planar channel which angle is different in comparison to FIG. 6. The embedded channel may also be shaped in the form of a wedge having planar walls (FIG. 8), concave walls (FIG. 9), convex walls (FIG. 10) or a combination thereof. In one embodiment, reflector 5 may be formed by a mirrored surface embedded into the material of sheet 30 (FIG. 11).

Figure 12:
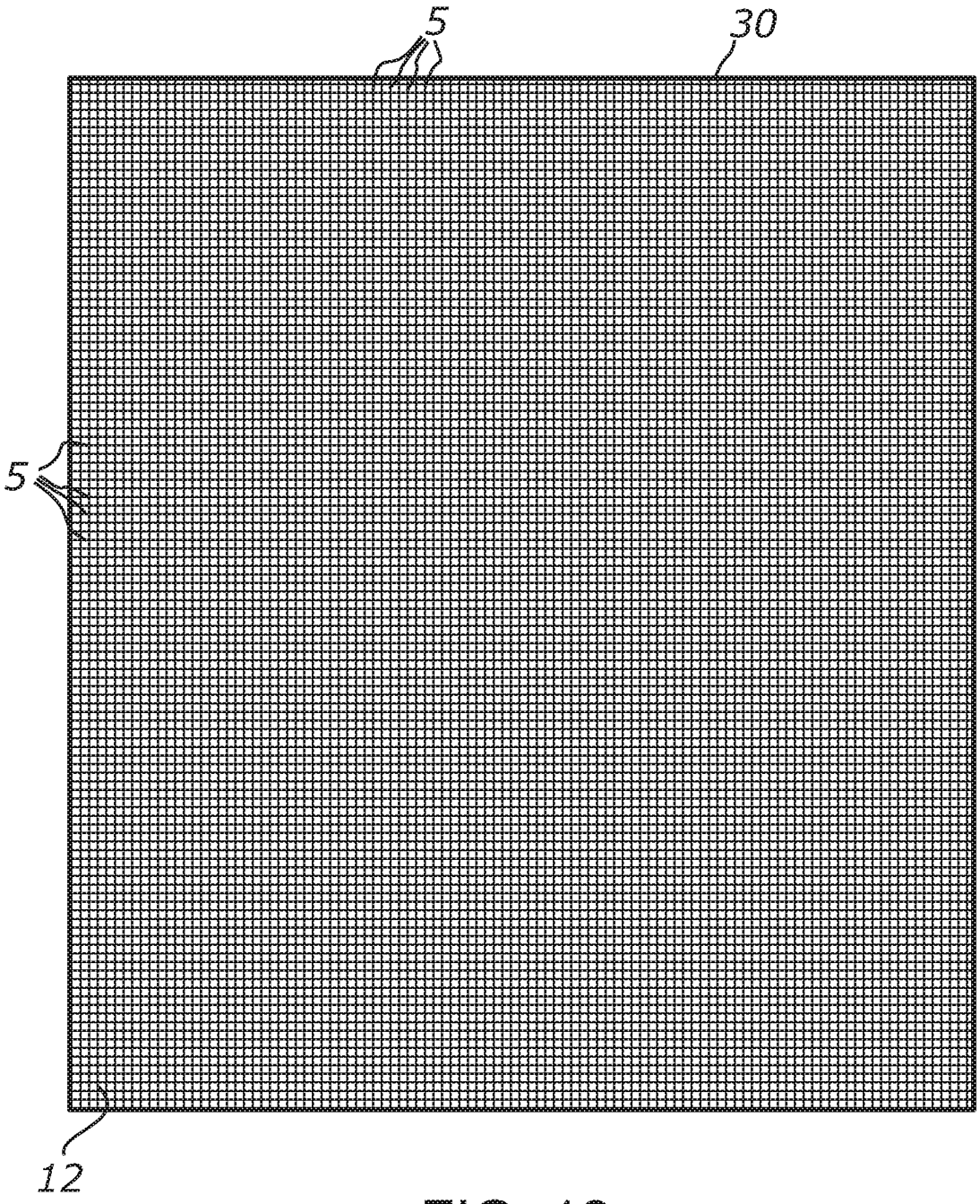
FIG. 12 is a schematic front view of a light directing sheet having two perpendicular arrays of linear reflectors, according to at least one embodiment of the present invention.

Linear reflectors 5 may be arranged into two or more arrays which may be arranged parallel or at an angle to each other. In one embodiment illustrated in FIG. 12, two such arrays of reflectors 5 can be formed, where a first parallel array of reflectors 5 is crossed at a right angle with respect to a second parallel array of reflectors 5, thus forming a perpendicular grid of reflectors 5. The two arrays may be formed within the same volume of the material of sheet 30 so that the respective reflectors 5 can intersect with each other. Alternatively, such arrays may be formed in different layers of sheet 30 or staggered within a single layer of sheet 30.

Figure 13:
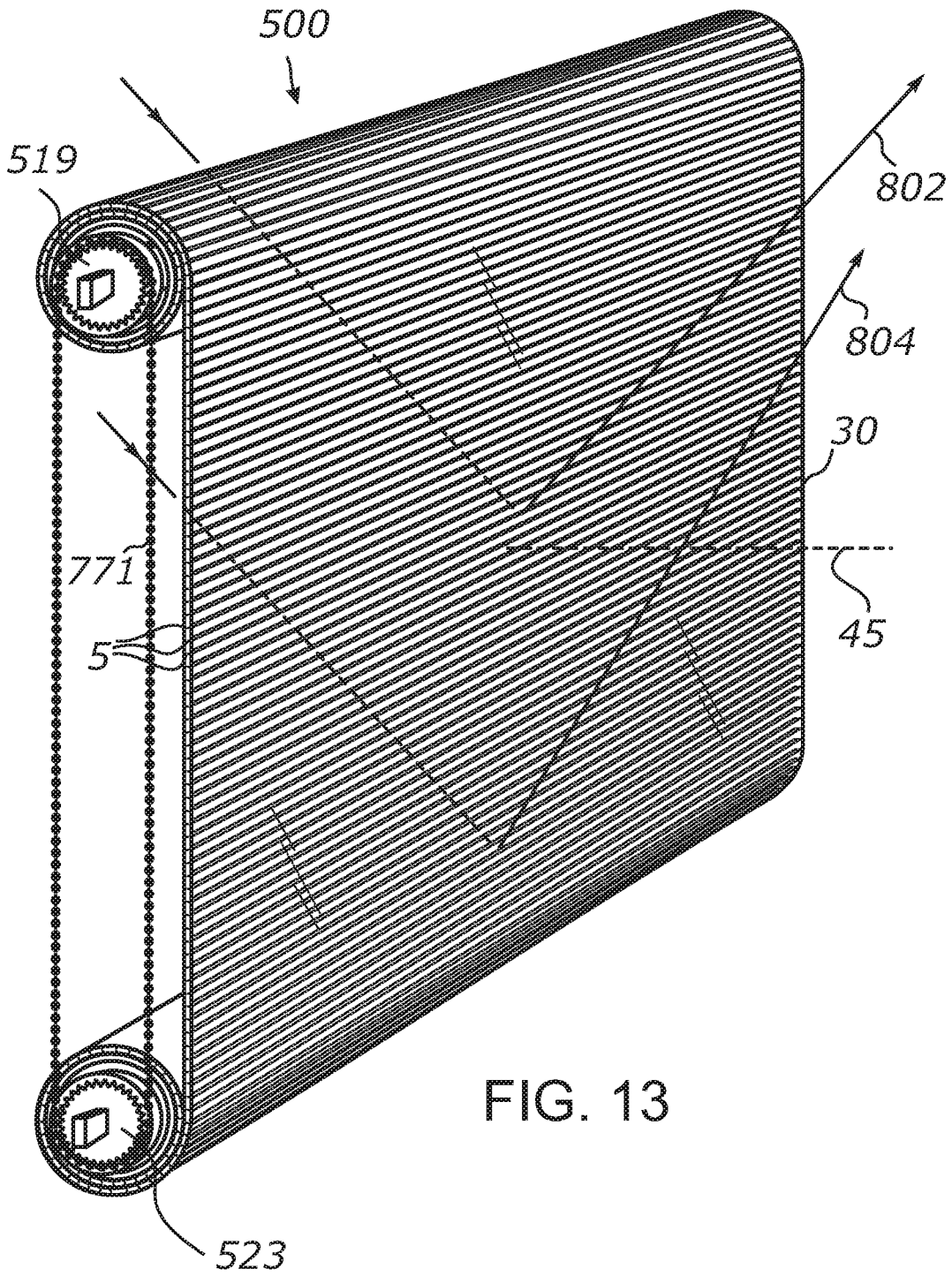
FIG. 13 is a schematic perspective view of a light-redirecting roller window covering, showing portions of a light directing sheet wound on two opposing rollers, according to at least one embodiment of the present invention.

FIG. 13 depicts an alternative embodiment of window covering 500 in which sheet 30 is windingly received around and stretched between roller 519 and an opposing second roller 523. Each of the rollers 519 and 523 is provided with a spring mechanism acting in the opposing directions with respect to the other roller so there is a slight tension maintained for sheet 30.

A bead chain 771 connected in a closed loop is provided to actuate both rollers 519 and 523 and to rewind sheet 30 from one of the rollers to the other. Bead chain 771 is run through the respective sprockets attached to each of the rollers to effectuate the positive bi-directional driving mechanism for the rollers. As the bead chain 771 is pulled by hand up or down, sheet 30 is thereby rewound from one roller to another.

The dihedral angle of reflectors 5 with respect to the major surfaces of sheet 30 may be varied within a predetermined angular range so as to cause different deflection angles for light rays striking sheet 30 at different locations along the winding direction. For instance, such dihedral angle may gradually change from a preselected minimum value at one terminal end of sheet 30 to a preselected maximum value at the opposing terminal end of the sheet. In the example illustrated in FIG. 13, the difference in dihedral angles of reflectors 5 is causing an incident light ray 804 that strikes sheet 30 closer to roller 523 to deflect by a greater angle than a parallel ray 802 that strikes sheet 30 closer to roller 519. The emergence angles of rays 802 and 804 with respect to surface normal 45 can thus be controlled by rewinding sheet 30 from one roller to another and exposing sheet portions that have different light bending characteristics.

When covering 500 of FIG. 13 is positioned parallel to a wall window in a vertical orientation with roller 519 being above roller 523, a parallel beam of direct sunlight striking sheet 30 will be directed towards the ceiling in a slightly converging beam. Furthermore, if sheet 30 is rewound from roller 523 to roller 519, new areas of sheet 30 and new reflectors 5 having greater dihedral angles will become exposed causing daylight deflection at even greater angles. It will be appreciated that, when such window covering is used to illuminate a room in a building by daylight entering a wall window, the greater deflection angles will generally result in directing the daylight towards the ceiling area which is closer to the respective window. Likewise, when sheet 30 is rewound back from roller 519 to roller 523, areas configured for lower deflection angles will become exposed to the incident daylight so that deeper areas of the room interior can be illuminated by the direct sunlight. Accordingly, by pulling bead chain 771 and thus rewinding sheet 30 to expose the desired area, the distribution of daylight and the illumination level in the room may be controlled to at least some degree. It is noted that since sheet 30 may be configured to have a very broad acceptance angle, basically up to ±90°, light coming from almost any direction may be transmitted into the room and at least a portion of such light may also be appropriately redirected.

Figure 14:
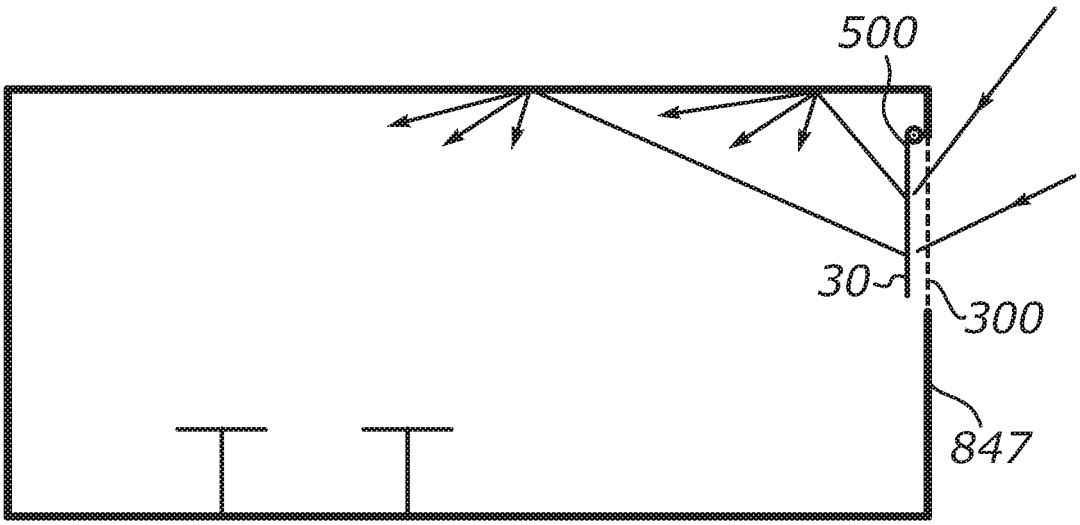
FIG. 14 is a schematic view of a building interior, showing a light-redirecting roller window covering attached to a building wall at a window location, according to at least one embodiment of the present invention.

The use of window covering 500 for illuminating a building interior with daylight is further illustrated in FIG. 14. Covering 500, such as that illustrated in FIG. 1, is attached to an interior side of wall 847 of a building facade just above a wall window 300 that is exposed to direct sunlight. Solar rays striking sheet 30 from different elevations are redirected to different locations of a ceiling which further scatters the redirected rays and thus advantageously redistributes daylight within the building interior. The amount of light intercepted by window covering 500 and redirected to the ceiling can be controlled by opening or closing the respective window cover. It is noted that, while window covering 500 of the type of FIG. 1 is schematically shown in FIG. 14 for illustrative purposes, the embodiment of window covering 500 of FIG. 13 may also be used in a similar manner.

It is further noted that window covering 500 of FIG. 13 may also be used to redirect and redistribute light from skylights and roof windows. In one embodiment, such a two-roller window covering may be configured to be mountable and operable in a horizontal orientation. In order to prevent or minimize sagging of sheet 30 in such orientation, a greater tension between the rollers may be provided compared to the tension which would normally suffice for the vertical orientation. Alternatively or in addition to this, a pair of rails or channels may be provided along the free sides of sheet 30 to support the weight of the sheet between rollers 519 and 523.

Figure 15:
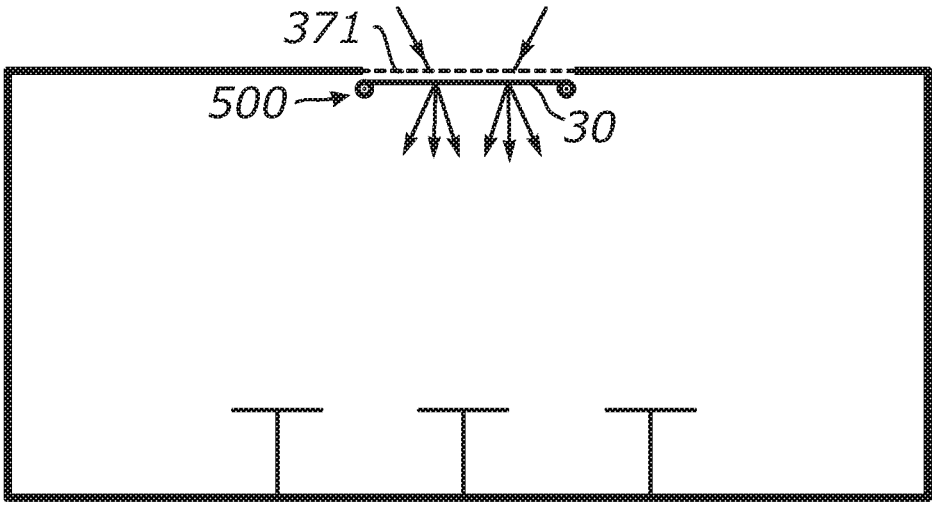
FIG. 15 is a schematic view of a building interior, showing a light-redirecting roller window covering attached to an opening in a ceiling of the building interior, according to at least one embodiment of the present invention.

FIG. 15 illustrates the operation of an embodiment of window covering 500 of FIG. 13 where it is used to redirect and redistribute light entering a building interior through a skylight 371. Referring to FIG. 15, window covering 500 may be disposed in a stationary position just below the glazed skylight opening. In one embodiment, the longitudinal axes of linear reflectors 5 as well as rollers 519 and 523 may be oriented east to west and the adjustment of rewind position of sheet 30 on the rollers may be performed manually on seasonal basis in response to the seasonal change in sun's elevation.

In one embodiment, such window covering 500 of may be implemented in an active sun tracking configuration where the longitudinal axes of linear reflectors 5 and rollers 519 and 523 may be positioned in a north-south orientation. One of the rollers 519 and 523 may be provided with an externally controlled reversible motor. The motor may be electrically connected to a controller which automatically adjusts the rewind position of sheet 30 on the rollers in response to the diurnal motion of the sun across the sky. The controller may be configured to receive input from a sun tracking sensor or, alternatively, the sun's position may be conventionally calculated onboard of the controller based on the latitude and time. Accordingly, sheet 30 of covering 500 may be periodically rewound in small predetermined increments during the day as the sun is traversing its east to west path so that the direct sunlight can be aimed along a vertical direction downwards regardless of the sun's position. When sheet 30 is additionally provided with light scattering features, such as surface texture or light diffusing material, the direct sunlight entering the room can be distributed more evenly with a reduced glare.

Figure 16:
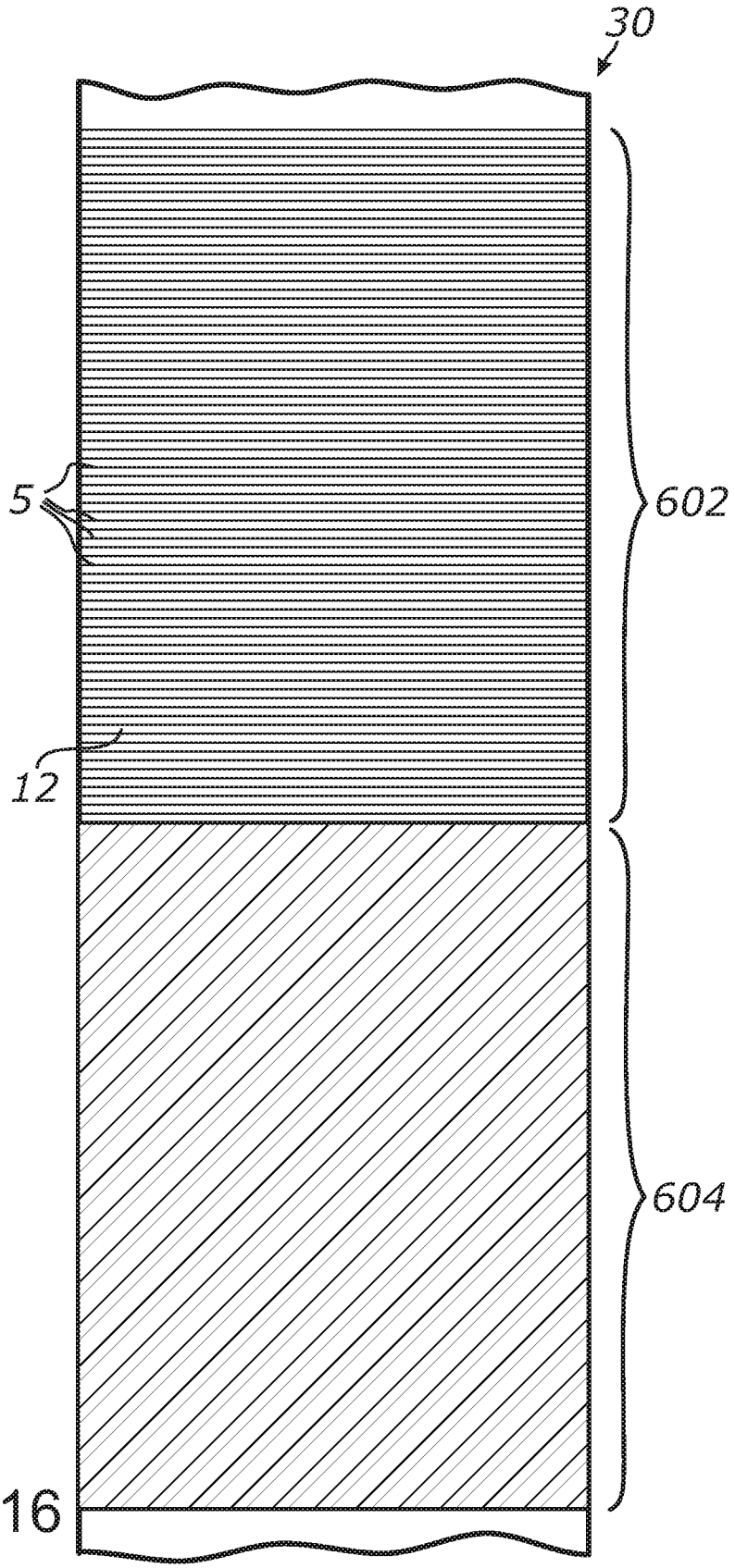
FIG. 16 is a schematic front view of a light directing sheet, showing an optically transmissive portion and an opaque portion of the sheet, according to at least one embodiment of the present invention.

Sheet 30 may include two or more sections having different optical properties, such as transparency, color or light redirecting properties. This is illustrated in FIG. 16 in which sheet 30 includes a section 602 and a section 604 occupying different areas along the length of the sheet. By way of example and not limitation, section 602 can be made from an optically transparent material and include light-redirecting reflectors 5 as described in the above embodiments, while section 604 may be made opaque or semi-transparent. Accordingly, by rewinding window covering 500 to fully expose section 602 of sheet 30, the users can configure covering 500 so that it will project daylight deep into the building interior while also optionally preserving the view, in which case the system will operate as a natural illumination device. Alternatively, the users may choose to fully or partially expose section 604 in order to partially or completely block the view and/or daylight penetration into the interior, in which case window covering 500 may act as a conventional sunlight shading device. It should be understood that sheet 30 may include as many sections as practical and each of such sections may be provided with specific light redirecting, shading and/or light filtering properties.

Figure 17:
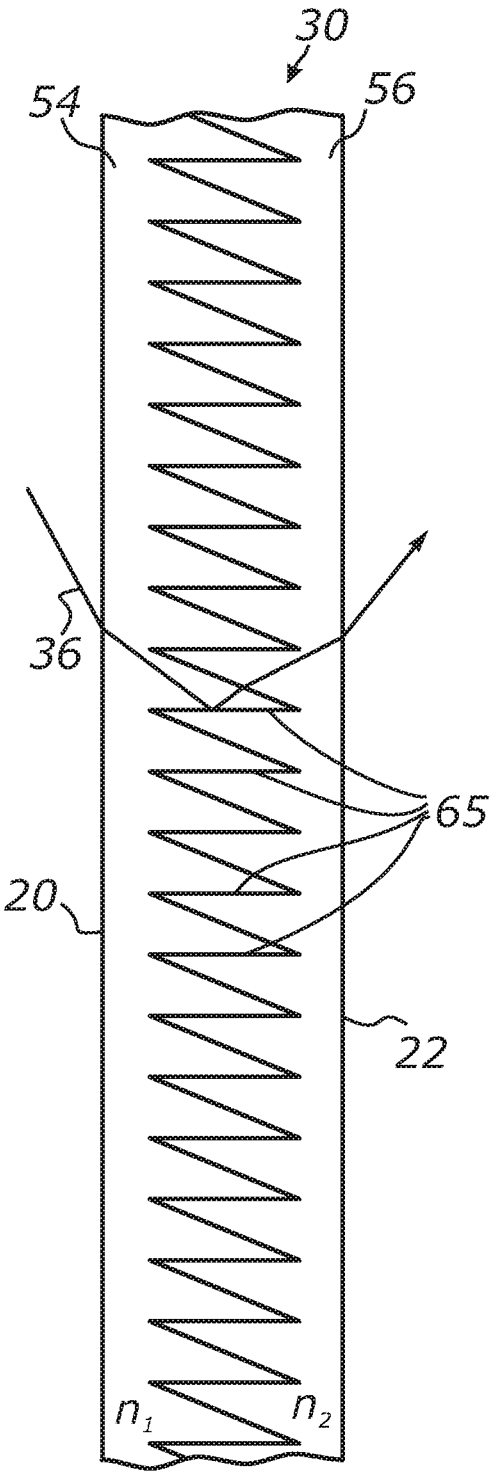
FIG. 17 is a schematic cross section view of a light directing sheet, showing two layers having different refractive indices and forming a corrugated boundary with each other, according to at least one embodiment of the present invention.

FIG. 17 shows an embodiment of sheet 30 including two layers 54 and 56 formed by two different polymeric materials which also have different refractive indices $n_1$ and $n_2$, respectively. Layers 54 and 56 form a continuous corrugated boundary with each other which also represents an optical interface characterized by a stepped change in refractive index. Sheet 30 is defined by opposing outer major surfaces 20 and 22 extending parallel to each other and being generally smooth and planar.

In the embodiment illustrated in FIG. 17, the corrugated boundary is formed by a plurality of triangular prismatic features each having a pair of facets forming different dihedral angles with respect to the prevailing plane of sheet 30. Various examples of light redirecting structures including corrugated optical interfaces with prismatic facets can be found in U.S. Pat. No. 9,004,726 herein incorporated by reference in its entirety.

At least some facets extend perpendicularly or near-perpendicularly to the surface of sheet 30. The refractive index $n_2$ is substantially lower than $n_1$ so that light incident onto such perpendicular facets at least at some incidence angles may experience TIR, as illustrated by the path of a light ray 36. Accordingly, such perpendicular facets form reflective surfaces 65 included into the body of sheet 30 and operating by TIR. It may be appreciated that, since the bend angle due to TIR is double the angle of incidence onto surfaces 65, the resulting bend angle of ray 36 will generally be greater than the incidence angle of ray 36 onto surface 20. Accordingly, when sheet 30 of FIG. 17 is incorporated into the retractable window covering 500, such window covering could redirect at least a portion of incident daylight to the ceiling and/or project such daylight deep into the interior space. Light rays which incidence angles are outside the range of TIR operation of reflective surfaces 65 may still be deflected from the original propagation path by means of refraction at such surfaces.

Figure 18:
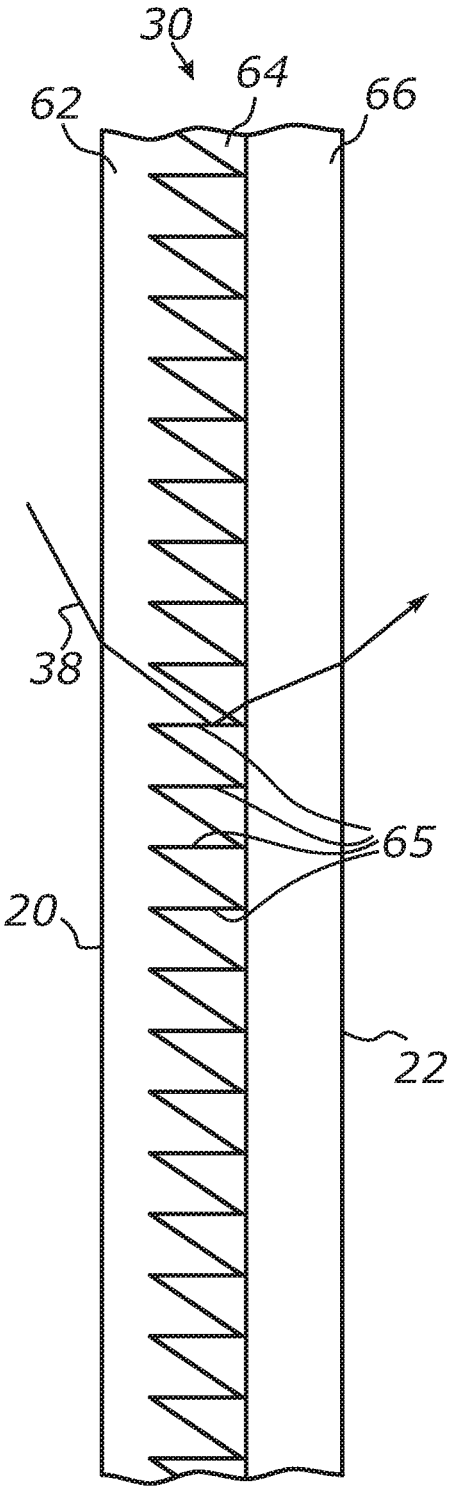
FIG. 18 is a schematic cross section view of a light directing sheet, showing a prismatic layer and an opposing cover layer, according to at least one embodiment of the present invention.

FIG. 18 shows an embodiment of sheet 30 in which sheet 30 includes a first polymeric layer 62, a second polymeric layer 66 and an intermediate layer 64 separating layers 62 and 66. Layer 64 may be represented by a layer of air or a polymeric low-n material. Layer 62 is formed by a prismatic film with surface microprisms facing layer 66. TIR surfaces 65 are formed by the respective surface microprisms each having a facet extending perpendicular to the film surface and configured to reflect light by means of TIR, as illustrated by an example of a light ray 38. When layer 64 is a low-n polymeric material, such material can be provided with suitable adhesive properties to hold layers 62 and 66 together while maintaining the flexibility of sheet 30. When layer 64 is air, layers 62 and 66 may be held together by a plurality of areas in which such layers are bonded to each other by an adhesive, spot welding or any other suitable means.

Sheet 30 may be provided with various additional means for enhancing the aesthetic appearance and/or structural strength. For example, sheet 30 may be hemmed or sewn along longitudinal edges in order to prevent warping or tearing at the edges. Such hemming or sewing may also provide decorative function. When sheet 30 is formed by two or more layers, one or more edges of the sheet may be sealed using an air and/or moisture impermeable encapsulating resin or tape. In one embodiment, the entire perimeter of sheet 30 can be sealed to prevent layer delamination and contamination of reflectors 5 with dust, dirt or moisture, especially when covering 500 is expected to be used in a harsh environment.

The appearance of sheet 30 or one or more its portions may be configured in a number of ways. For instance, a pigment may be added to its materials thus altering its color or transparency. Particularly, the optical clarity either sheet of sheet 30 may be advantageously reduced in some applications that require more privacy so that objects behind the sheet can be masked and/or blurred. In one embodiment, sheet 30 may be tinted or configured for suitable light filtering properties, such as blocking the infra-red or ultraviolet rays, etc. In addition, any suitable image or pattern may be embossed or printed on either surface of sheet 30 for decorative purposes. The print may be opaque or transparent/semitransparent and suitable printing techniques may include but are not limited to digital printing, screen printing, stencil-printing, selective dyeing and painting.

Further details of the structure and operation of window covering 500, as shown in the drawing figures, as well as their possible variations will be apparent from the foregoing description of preferred embodiments. Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A light redirecting window covering, comprising:

a flexible translucent sheet of a plastic material having a first broad-area surface and an opposing second broad-area surface extending parallel to the first broad-area surface;

a plurality of random surface microstructures formed in the first broad-area surface and configured for randomizing light propagation directions;

a parallel array of truncated linear prismatic structures formed on the second broad-area surface and extending parallel to an edge of the flexible translucent sheet, wherein each of the prismatic structures has a tapered shape and comprises a first curved side wall forming a first non-zero angle with respect to a normal to the second broad-area surface, a second curved side wall extending at a different non-zero angle with respect to the normal, and a terminal surface facing away from the flexible translucent sheet and connecting the first and second curved side walls; and a flexible optically transmissive sheet bonded to the terminal surfaces of the truncated linear prismatic structures using an optically transmissive adhesive so as to form a single layered flexible film structure adapted for being retained in a planar form and further adapted for being retained in a form of a roll, wherein at least one of the first and second curved side walls is configured for reflecting light using a total internal reflection, and wherein at least one of the first and second curved side walls is configured for deflecting light using refraction.

2. The light redirecting window covering of claim 1, wherein the flexible translucent sheet is configured to diffusely redirect incident light generally towards a direction that is not coincident with an incident propagation direction.

3. The light redirecting window covering of claim 1, further comprising a roller, wherein an end of at least one of the flexible translucent sheet and flexible optically transmissive sheet is windingly received around the roller.

4. The light redirecting window covering of claim 1, further comprising a roller, wherein an end of at least one of the flexible translucent sheet and flexible optically transmissive sheet is windingly received around the roller, and wherein at least one the truncated linear prismatic structures is parallel to a rotation axis of the roller.

5. The light redirecting window covering of claim 1, wherein each of the truncated linear prismatic structures is configured to be operable in horizontal orientation.

6. The light redirecting window covering of claim 1, wherein a portion of at least one of the first and second curved side walls is disposed in contact with an optically transmissive material.

7. The light redirecting window covering of claim 1, wherein a portion of at least one of the first and second curved side walls is disposed in contact with an optically transmissive material having a different refractive index than the material of the truncated linear prismatic structures.

8. The light redirecting window covering of claim 1, wherein the layered flexible film structure is configured to appreciably distort or blur images viewable through the layered flexible film structure.

9. The light redirecting window covering of claim 1, wherein a root mean square surface profile roughness parameter of at least a portion of the first or second curved side walls is less than 60 nanometers at a sampling length of between 20 and 100 micrometers.

10. The light redirecting window covering of claim 1, wherein the layered flexible film structure comprises an elastomeric material.

11. The light redirecting window covering of claim 1, comprising an optically transmissive protective layer bonded to a surface of the layered flexible film structure.

12. The light redirecting window covering of claim 1, wherein the truncated linear prismatic structures define a plurality of voids in the layered flexible film structure.

13. The light redirecting window covering of claim 1, wherein a thickness of the layered flexible film structure is between 200 micrometers and 2 millimeters.

14. The light redirecting window covering of claim 1, wherein the layered flexible film structure has two or more sections having different optical transparency.

15. The light redirecting window covering of claim 1, wherein the layered flexible film structure has two or more sections having different light redirecting properties.

16. The light redirecting window covering of claim 1, wherein a terminal end of at least one of the truncated linear prismatic structures has a triangular shape in a cross-section.

17. The light redirecting window covering of claim 1, wherein the parallel array of truncated linear prismatic structures defines a plurality of voids filled with air.

18. The light redirecting window covering of claim 1, comprising an optically transmissive protective layer bonded to a surface of the layered flexible film structure, wherein a thickness of the layered flexible film structure is between 200 micrometers and 2 millimeters, wherein a portion of at least one of the first and second curved side walls is disposed in contact with an optically transmissive material, wherein the parallel array of linear prismatic structures defines a plurality of voids filled with air, wherein each of the linear prismatic structures is configured to be operable in horizontal orientation, and wherein the flexible translucent sheet is configured to diffusely redirect incident light generally towards a direction that is not coincident with an incident propagation direction.

19. The light redirecting window covering of claim 1, comprising an optically transmissive protective layer bonded to a surface of the layered flexible film structure, wherein a thickness of the layered flexible film structure is between 200 micrometers and 2 millimeters, wherein a portion of at least one of the first and second curved side walls is disposed in contact with an optically transmissive material, wherein the parallel array of linear prismatic structures defines a plurality of voids filled with air, wherein a terminal end of at least one of the truncated linear prismatic structures has a triangular shape in a cross-section, wherein each of the linear prismatic structures is configured to be operable in horizontal orientation, and wherein the flexible translucent sheet is configured to diffusely redirect incident light generally towards a direction that is not coincident with an incident propagation direction.

20. A light redirecting window covering, comprising:

a flexible translucent sheet of a plastic material having a first broad-area surface and an opposing second broad-area surface extending parallel to the first broad-area surface;

a plurality of random surface microstructures formed in the first broad-area surface and configured for randomizing light propagation directions;

a parallel array of linear prismatic structures formed on the second broad-area surface and tapering away from the second broad-area surface in a perpendicular direction, wherein each of the linear prismatic structures has a first curved side wall forming a first non-zero angle with respect to a normal to the second broad-area surface, a second curved side wall forming a different non-zero angle with respect to the normal, and a terminal surface facing away from the flexible translucent sheet and connecting the first and second curved side walls; and a flexible optically transmissive sheet bonded to the terminal surfaces of the linear prismatic structures using an optically transmissive adhesive so as to form a single layered flexible film structure adapted for being retained in a planar form and further adapted for being retained in a form of a roll, wherein at least one of the first and second curved side walls is configured for reflecting light using a total internal reflection, and wherein at least one of the first and second curved side walls is configured for deflecting light using refraction.

21. The light redirecting window covering of claim 20, comprising an optically transmissive protective layer bonded to a surface of the layered flexible film structure, wherein a thickness of the layered flexible film structure is between 200 micrometers and 2 millimeters, wherein a portion of at least one of the first and second curved side walls is disposed in contact with an optically transmissive material, wherein the parallel array of linear prismatic structures defines a plurality of voids filled with air, wherein each of the linear prismatic structures is configured to be operable in horizontal orientation, and wherein the flexible translucent sheet is configured to diffusely redirect incident light generally towards a direction that is not coincident with an incident propagation direction.

22. The light redirecting window covering of claim 20, comprising an optically transmissive protective layer bonded to a surface of the layered flexible film structure, wherein a thickness of the layered flexible film structure is between 200 micrometers and 2 millimeters, wherein a portion of at least one of the first and second curved side walls is disposed in contact with an optically transmissive material, wherein the parallel array of linear prismatic structures defines a plurality of voids filled with air, wherein a terminal end of at least one of the linear prismatic structures has a triangular shape in a cross-section, wherein each of the linear prismatic structures is configured to be operable in horizontal orientation, and wherein the flexible translucent sheet is configured to diffusely redirect incident light generally towards a direction that is not coincident with an incident propagation direction.

* * * * *